US009963206B2

(12) United States Patent
Kalve

(10) Patent No.: US 9,963,206 B2
(45) Date of Patent: May 8, 2018

(54) MULTI CRADLE APPARATUS

(71) Applicant: Vestdavit Gruppen AS, Laksevåg (NO)

(72) Inventor: Atle Kalve, Hordvik (NO)

(73) Assignee: Vestdavit Gruppen AS, Laksevåg (NO)

( * ) Notice: Subject to any disclaimer, the term of this patent is extended or adjusted under 35 U.S.C. 154(b) by 0 days. days.

(21) Appl. No.: 15/029,017

(22) PCT Filed: Nov. 5, 2014

(86) PCT No.: PCT/NO2014/050210
§ 371 (c)(1),
(2) Date: Apr. 13, 2016

(87) PCT Pub. No.: WO2015/069118
PCT Pub. Date: May 14, 2015

(65) Prior Publication Data

US 2016/0221645 A1 Aug. 4, 2016

(30) Foreign Application Priority Data

Nov. 8, 2013 (NO) ..... 20131491

(51) Int. Cl.
*B63B 35/40* (2006.01)
*B63B 23/32* (2006.01)
(Continued)

(52) U.S. Cl.
CPC ..... *B63B 23/32* (2013.01); *B63B 23/26* (2013.01); *B63B 27/36* (2013.01); *B63B 35/40* (2013.01); *B63C 3/12* (2013.01)

(58) Field of Classification Search
CPC ..... B63B 27/36; B63B 35/40; B63B 23/00; B63C 3/08; B63C 3/12
See application file for complete search history.

(56) References Cited

U.S. PATENT DOCUMENTS 1,118,499 A 11/1914 Lake
2,319,855 A * 5/1943 Forsberg ..... B63B 35/40 114/259
2006/0182554 A1 8/2006 Stolzer

FOREIGN PATENT DOCUMENTS

DE 1965838 A1 7/1971
DE 3635238 A1 5/1987
(Continued)

OTHER PUBLICATIONS

Carlström, Göran, "International Search Report," prepared for PCT/NO2014/050210, dated Feb. 10, 2015, four pages.

*Primary Examiner* — Andrew Polay
(74) *Attorney, Agent, or Firm* — Winstead PC

(57) ABSTRACT

An apparatus (1) for handling daughter boats (2) on a mother vessel comprising one davit assembly positioned atop a stationary cradle (5), each of which is located near a side edge (11*a*, 11*b*) of a deck (11) of the vessel for launching and retrieving the boats (2) from and onto the stationary cradle (5) characterised in that the apparatus has a plurality of longitudinally movable cradles (7) on the deck (11) of the vessel for securedly holding plurality of boats thereon and in that the longitudinally movable cradles can move back and forth longitudinally and lift up vertically to transfer a boat (2) onto or to receive a boat (2) from, one transversely movable cradle (4) which can transversely move back and forth for placing a boat (2) onto or for receiving a boat (2) from, the longitudinal cradles (7) and any one stationary cradle (5). The invention also relates to a method for launching and retrieving boats from a mother vessel.

8 Claims, 20 Drawing Sheets

(51) Int. Cl.

| | |
|---|---|
| ***B63B 27/36*** | (2006.01) |
| ***B63B 23/26*** | (2006.01) |
| *B63C 3/12* | (2006.01) |

(56) References Cited

FOREIGN PATENT DOCUMENTS

| | | | |
|---|---|---|---|
| GB | 527599 | A | 10/1940 |
| GB | 580241 | A | 9/1946 |
| JP | 2002087376 | A | 3/2002 |
| NO | 131236 | B | 1/1975 |
| WO | WO-2012069853 | A2 | 5/2012 |

* cited by examiner

MULTI CRADLE APPARATUS

FIELD OF THE INVENTION

The present invention in general, relates to an apparatus for launching and recovering boats from and onto a mother vessel or a ship.

Particularly, the present invention relates to handling of daughter boats on a mother vessel, which apparatus can, accommodate, a substantially large number of daughter boats on the deck of the mother vessel and can launch and retrieve substantially large number of daughter boats, applying only a limited number of davits, making the overall arrangement very simple.

More particularly, the present invention relates to an apparatus for handling daughter boats on a mother vessel according to the preamble of claim 1 and to a methodology for launching and retrieving daughter boats from and onto a mother vessel, according to the preamble of claims 7 and 8 respectively.

TECHNICAL BACKGROUND OF THE INVENTION

Apparatuses/devices for launching and recovery of daughter boats from and onto a mother vessel/ship are already known.

Such mother boats may be lifeboats or rigid inflatable boats (commonly termed RIBs) and other designs of boats or vessels, often deployed by the navy or by maritime rescue operators.

For launching daughter boats from a mother vessel, davits are connected to a line at each end of the boat and the boat is hoisted into water. This is time consuming and leaves the chances of detachment of the boats wide open. Similar chances exist during recovery of the mother boat as well. Hence, this traditional method and similar such methods have potentialities of causing loss of life and material.

Deployment of ramp to avoid the problem in the aforesaid paragraph is known but then chances of collision exist in such ramp technology, which is nonetheless dangerous.

Slightly more advanced technology for launching and recovery of daughter boats are also known. Davit assemblies on each side of the mother vessel are known, which are placed above a stationary cradle. Several transversely movable cradles carry these boats below the davit assemblies on the stationary cradle along rails for launching. However, the existence of too many transversely movable cradles limit the total space available for handling the daughter boats on the deck of the mother vessel. Further, too many davit assemblies have to be deployed for picking up the boats from the transversely moving cradles and for launching and retrieving the boats.

Japanese patent publication JP2002087376, discloses a simplified construction of a davit type boat-lifting device comprising a pair of hydraulically drivable columnar cradles turnably connected to a mother ship. A pair of wire ropes are delivered from the turnable ends of the cradle. The cradles are turned and a mounted boat lifted via wire ropes is lifted into and out of the mother ship. WO 20122069853, discloses a cradle for launching and recovering a boat. The cradle is shaped to have an axis and to support a boat. A moving mechanism moves the cradle in a first stowed position and to a second ramp position.

U.S. Pat. No. 1,118,499 A describes an apparatus for launching lifeboats from ships, comprising a series of frames pivotally mounted on the side of the ship, where each frame having a horizontal boat supporting member, said members being arranged out of horizontal alinement, and rollers carried by said horizontal members.

U.S. Pat. No. 2,319,855 A describes a motor torpedo boat carrier having upper and lower decks, a compartment between the decks for stowing motor torpedo boats, a hatch in the upper deck communicating with said compartment, a movable cradle in said compartment for supporting a motor torpedo boat, vertical guide rails in said compartment adjacent and supported by said hatch, upstanding arms on said cradle adapted to interlock with said guide rails for guiding the vertical movement of the cradle, a travelling carriage on the upper deck for carrying said cradle across the upper deck, depending guide rails carried by said carriage adapted to align with the guide rails in said compartment for coacting with the arms on said cradle.

U.S. Pat No. 1,361,236 B describes a device for launching lifeboats from a ship, where the lifeboats are stored in a room in the aft part of the ship, from which room to a location close to the ship's water line a glide path in the form of a downward inclined tunnel to convey the lifeboats, is provided.

The prior art documents acknowledged in the preceding paragraph and similar such documents not only have a complicated construction, but also fail to teach a simple mechanism by means of which a large number of daughter boats can be handled on and from the mother vessel, using a fewer number of davits. Further, prior art technology does not specifically teach how a single davit can handle a substantially large number of daughter boats.

The present invention solves the drawbacks of prior art as recited in the preceding paragraph and meets other associated needs by applying a very simple apparatus having a plurality of longitudinally movable cradles which can securely hold, receive, lift and lower daughter boats and can simultaneously interact with a single transversely movable cradle. A single davit can pick up or deliver on the transversely movable cradle, a large number of daughter boats one after another.

OBJECTS OF THE INVENTION

It is the principal object of the present invention to provide an apparatus and methodology for handling daughter boats on a mother vessel, which can accommodate, a substantially large number of daughter boats on the deck of the mother vessel and can launch and retrieve substantially large number of daughter boats, applying only a limited number of davits.

Another object with present invention is to provide an apparatus of the above-mentioned kind, avoiding crossing of rails in order to achieve a substantially flushed deck.

It is another object of the present invention to provide an apparatus and methodology for handling daughter boats on a mother vessel such that a single davit can launch and retrieve a substantially large number of daughter boats one after another.

It is a further object of the present invention to provide an apparatus for handling daughter boats on a mother vessel which has a simple construction and is cost effective and boats can be launched selectively and also parked in desired locations.

All through the specification including the claims, the words "vessel", "ship", "daughter boat" "life boat", "cradle", "davit/davit assembly", "deck", to be interpreted in the broadest sense of the respective terms and includes all similar items/devices/methods in the field known by other terms, as may be clear to persons skilled in the art.

Restriction/limitation, if any, referred to in the specification, is solely by way of example and understanding the present invention.

SUMMARY OF THE INVENTION

Present invention relates to an apparatus for handling daughter boats on a mother vessel comprising one davit assembly positioned atop a stationary cradle, each of which is located near a side edge of a deck of the vessel for launching and retrieving the boats from and onto the stationary cradle wherein the apparatus has a plurality of longitudinally movable cradles on the deck of the vessel for securely holding plurality of boats thereon and that the longitudinally movable cradles can move back and forth longitudinally and lift up vertically to transfer a boat onto or to receive a boat from, one transversely movable cradle which can transversely move back and forth for placing a boat onto or for receiving a boat from, the longitudinal cradles and any one stationary cradle.

The invention also relates to a method for launching boats by applying the above apparatus according, wherein the method comprises the following steps:

a) moving the transversely movable cradle along the transverse rail and positioning it selectively in line with the longitudinal cradle on which a boat desired to be launched is positioned;
b) applying the lifting device to lift up the boat on the longitudinal cradle and moving the boat and the longitudinally movable cradle along longitudinal rail (3*b*) towards the transverse cradle;
c) on reaching a suitable location very near the transverse cradle, placing the boat on the transverse cradle by lowering the lifting device;
d) moving back the longitudinally cradle along the deck back to its original position on the deck;
e) moving the transverse cradle near any one stationary cradle along the transverse rail;
f) on reaching a suitable position, placing the boat on the stationary cradle;
g) lifting the boat by a davit to allow the transversely movable cradle to move away from the stationary cradle for bringing further boats, using the davit to place the boat on the stationary cradle and launching the boat on sea applying the davit;
h) repeating steps (a) to (g) as many times as required.

Further preferred features of the invention are presented in the dependant claims

BRIEF DESCRIPTION OF THE DRAWINGS

Having described the main features of the invention above, a more detailed and non-limiting description of an exemplary embodiment, with reference to the drawings is provided below.

Similarly.

DETAILED DESCRIPTION OF THE INVENTION

Figure 1A:
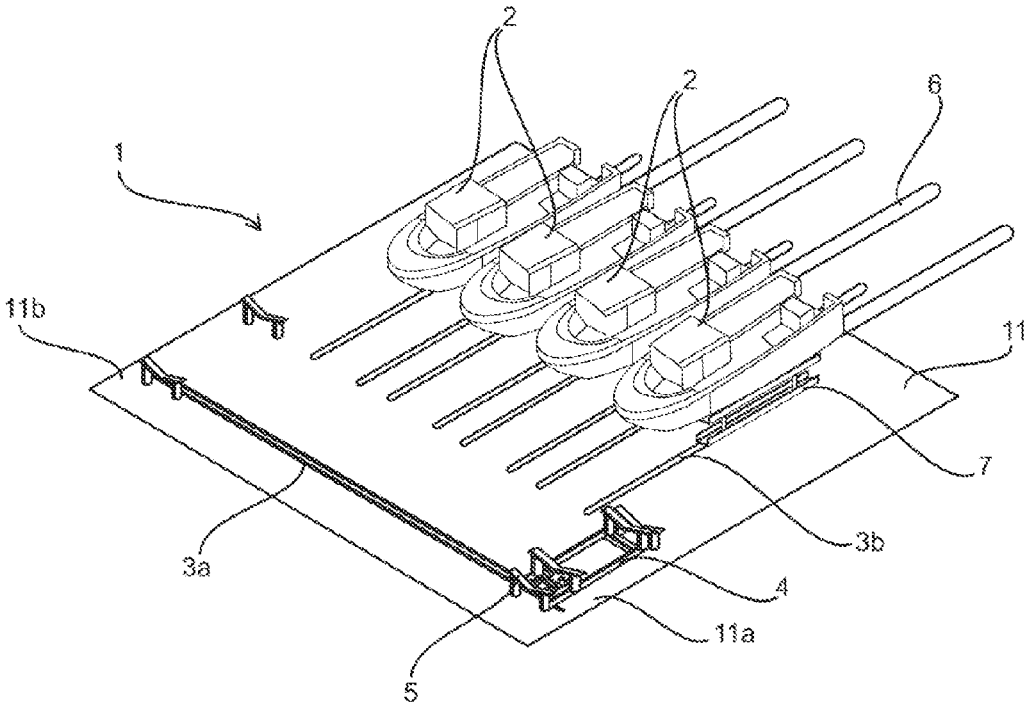
FIG. 1*a* is a perspective view of the apparatus of the present invention according to a preferred embodiment when the launching operation has not begun.

The following describes a preferred embodiment of the present invention which is purely exemplary for the sake of understanding the invention and non-limiting.

In all the figures, like reference numerals represent like features. Further, when in the following it is referred to "top", "bottom", "upward", "downward", "above" or "below" , "right hand side " or "left hand side" and similar terms , this is strictly referring to an orientation with reference to the deck is considered to be horizontal with the sea bed, where the sea bed is considered to be horizontal and at the bottom.

It should also be understood that the orientation of the various components might be otherwise than shown in the drawings, without deviating from the principle of the invention. Furthermore, the vessel/ship in detail, davits/davit assemblies and other related units are not shown in detail, as those are not consequential to the present invention and should be understood by persons skilled in the art.

The number of components shown in the figures can also vary within the scope of the present invention. Furthermore, the description refers to lifeboats on a ship and similarly the figures also illustrate lifeboats. This is for the sake of simplicity. It should be understood that other daughter boats/vessels as may be known, also fall within the scope of the present invention.

FIG. 1*a* is a perspective view of the basic structure of the apparatus 1. It comprises of a transverse rail 3*a* at a slightly elevated height above the deck 11 of a vessel (not shown as confirmed at the outset of detailed description of the invention). A single transversely movable cradle 4 moves back and forth along this rail 3*a*, on wheels(not shown) along both sides of the vessel, such that it can rest atop a stationary cradle 5, each of such stationary cradle 5, being ideally located at the two lateral ends 11*a* of the deck 11.

However, there can be more than two stationary cradles 5. In that event, a single transversely movable cradle 4 would interact with every two such stationary cradles 5, one each on either side of the vessel. This would be further clear, on perusing the description of functioning of the invention, a little later.

The transversely movable cradle 4 can move along the transverse rail 3*a* by rack and pinion arrangement 20 or by other means. The movement is transverse to the normal direction of propelling of the vessel. This is again explained with reference to the exploded view in FIG. 1*b* a little later.

Figure 1B:
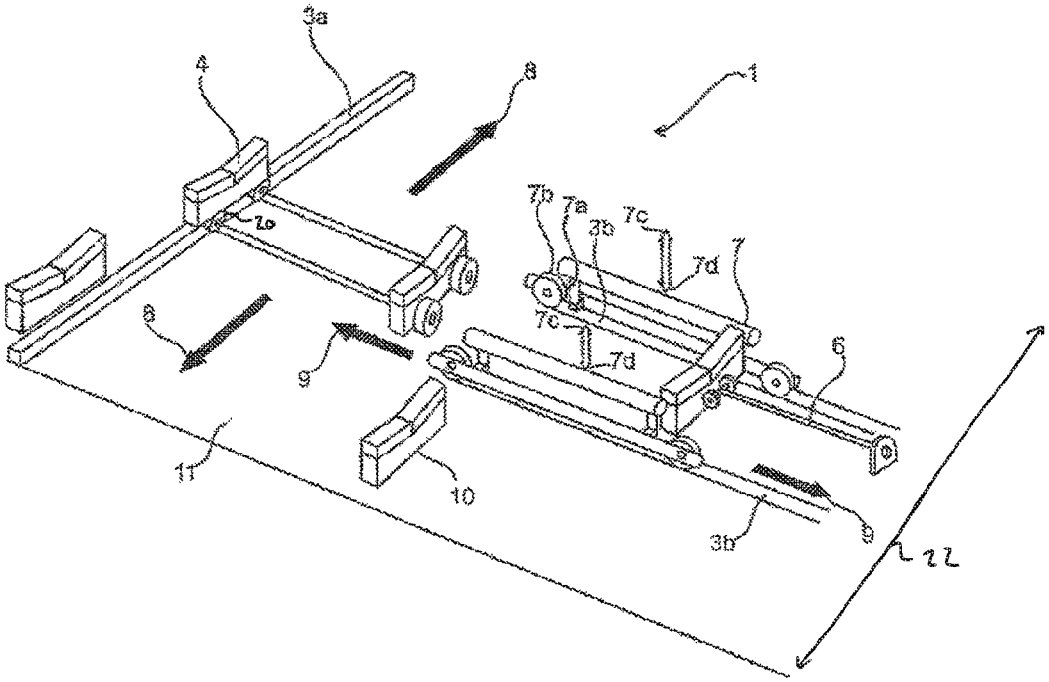
FIG. 1*b* is an exploded view of the apparatus shown in FIG. 1*a* but without the daughter boats for the sake of simplicity and understanding.

Referring again to FIG. 1*a*, the deck 11 also has a plurality of longitudinally movable cradles 7, which can move in longitudinal direction back and forth along the longitudinal rail 3*b*, on wheels 7*b* (best shown in FIG. 1*b*). The longitudinal cradles 7 have a hydraulic cylinder 6 arrangement for moving back and forth, but other methods are also within the scope of the present invention. It would clear from FIG. 1*b* which is discussed a little later that these cradles 7 move longitudinally along the normal direction of propulsion of the vessel.

Each longitudinally movable cradle 7 can securely hold a lifeboat 2. In the FIG. 1*a* only four longitudinal cradles 7 parking four lifeboats 2 are shown by way of example. So there is a dedicated longitudinally movable cradle 7 for each lifeboat 2. which can be parked on such cradle 7. A life boat 2 can be parked on fixed keel rests 10 (best shown in FIG. 1*b*) along a transverse hanger 22 on the vessel and as it would be clear from the subsequent description of functioning of the invention a little later, the longitudinally movable cradles 7 can move such a life boat 2 from the hanger (not shown) to the davit assembly.

FIG. 1*b* is an exploded view of the apparatus 1 without the lifeboats 2. It shows the transversely movable cradle 4 which can move along the transverse rail 3*a*. It can move in either direction 8 which is always transverse to the normal direction of propulsion of the vessel. This figure also shows the longitudinally movable cradles 7 which can move back and forth in a direction 9 parallel to the direction of movement of the vessel along the longitudinal rail 3*b*, on wheels 7*b*. The hydraulic cylinder arrangement 6 facilitates such movement. The fixed keel rests 10 can also be seen which can park the lifeboats 2.

The FIG. 1*b* will be taken up again while explaining the functioning of the invention.

Referring again to FIG. 1*a* it would be clear that the transversely movable cradle 4 has a rail 3*a* and wheels only at one end. The other end is free from which end it receives lifeboats 2 as it would be clear from the functioning explained a little later.

Figure 1C:
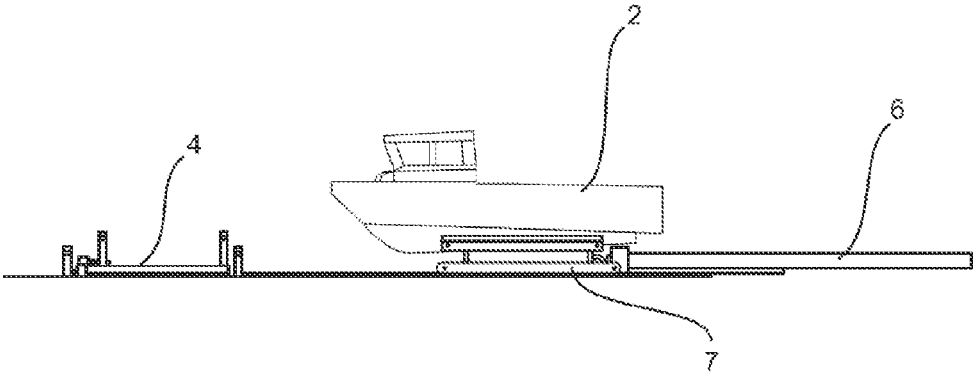
FIG. 1*c* is a side view of the apparatus shown in FIG. 1*a*.

FIG. 1*c* is a side view of the apparatus shown in FIG. 1*a*. From side, only one lifeboat 2 is visible which rests on the longitudinally movable cradle 7. This figure also shows the transversely movable cradle 4 atop the stationary cradle 5. The difference in height between the transversely movable cradle 4 and the stationary cradle 5 is evident from this FIG. 1*c*.

Figure 1D:
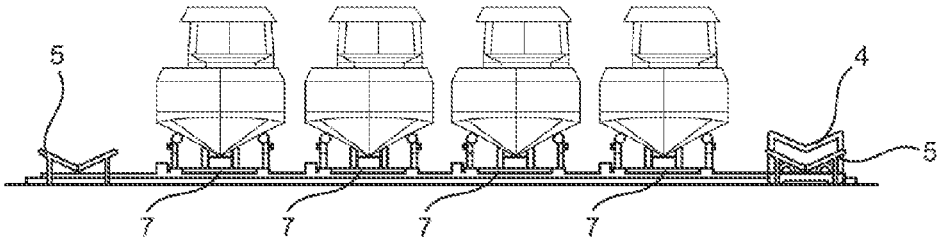
FIG. 1*d* is a front view of the apparatus shown in FIG. 1*a*.

The front view of the apparatus 1 is shown in FIG. 1*d*. All the four lifeboats 2 can be seen which are parked on respective dedicated longitudinally movable cradle 7. A the left side of the FIG. 1*d* there is a stationary cradle 5 without any transverse cradle 4 atop it. However, on the right side of the FIG. 1*d* it is worth noticeable that a transversely movable cradle 4 is atop the stationary cradle 5.

For every two stationary cradle 5 on either side 11*a*, 11*b* (best shown in FIG. 1*a*) there is a single transversely movable cradle 4, which can move along both sides for launching and retrieving life boats 2 at both sides 11*a*, 11*b* of the vessel. These are explained in more detail a little later.

FIGS. 2*a*, 3*a*, 4*a*, 5*a*, 6*a*, 7*a*, 8*a*, 9*a* and 10*a* are different stages of launching operation of lifeboats. The corresponding side views and front views respectively of FIGS. 2*a*, 3*a*, 4*a*, 5*a*, 6*a*, in that order are 2*b* and 2*c*, 3*b* and 3*c*, 4*b* and 4*c*, 5*b* and 5*c*, 6*b* and 6*c*. FIGS. 7*b*, 8*b*, 9*b* and 10*b* are front views of the corresponding perspective views 7*a*, 8*a*, 9*a* and 10*a*. These shall be referred to again while explaining the functioning of the apparatus.

Figure 11A:
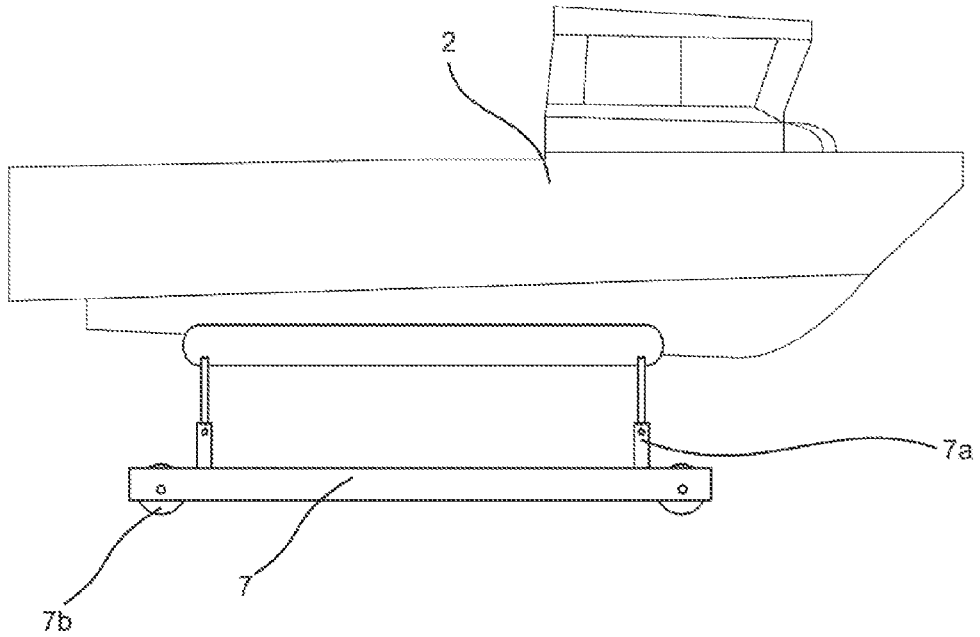
FIG. 11*a* is an enlarged side view of a longitudinally movable cradle with lifting units moved up to lift the daughter boat.

Referring to FIG. 11*a*, an enlarged side view of a longitudinal cradle 7 is shown.

It has a telescopic lifting device 7*a* which is hydraulically operable. FIG. 11*a* is a position where, the lifting device 7*a* has moved vertically up to lift the cradle 7 along with the lifeboat 2 for placing it on the transversely movable cradle 4. This would be clear from the corresponding front view in FIG. 12*a* which corresponds to the position shown in FIG. 11*a*. It can be seen clearly from FIG. 12*a* that the longitudinally movable cradle 7 has lifted the boat 2 and moved along the rail 3*b* (best shown in FIG. 1*a*) to very near the transversely movable cradle 4.

Figure 12A:
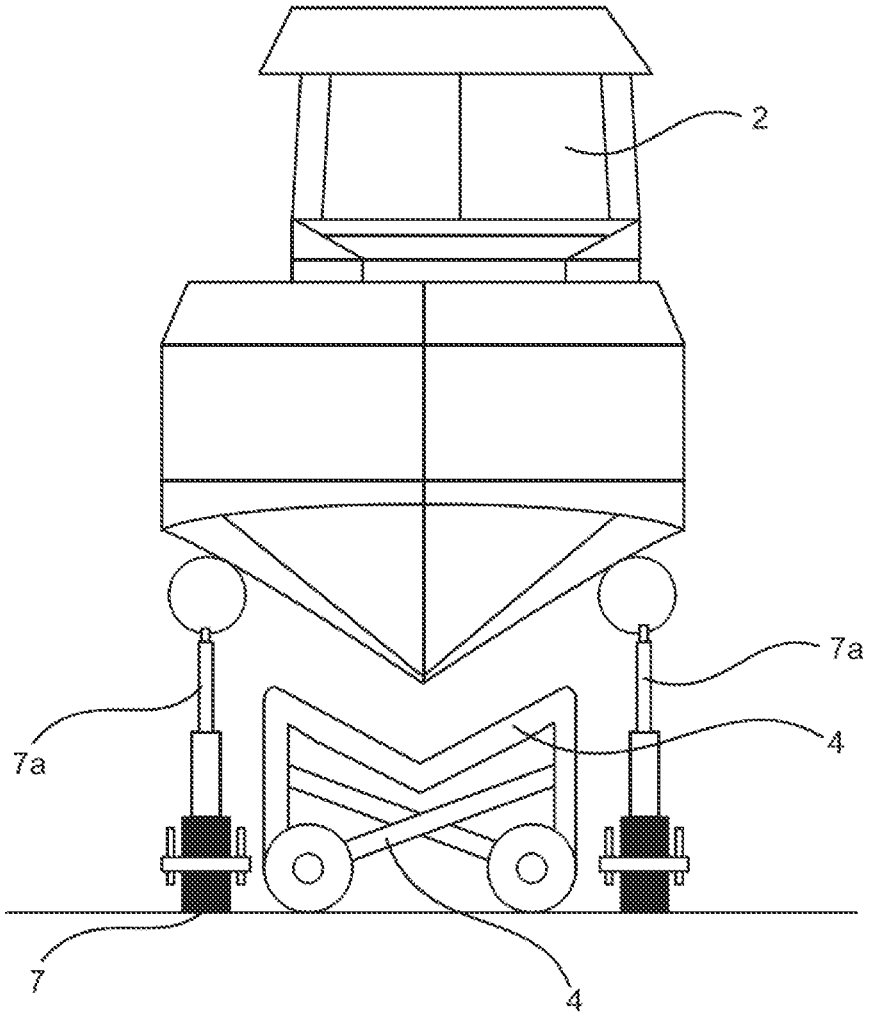
FIGS. 12*a* and 12*b* are corresponding front views respectively of FIGS. 11*a* and 11*b*.

The FIG. 12*a* shows that the boat 2 is now atop the transversely movable cradle 4.

Figure 11B:
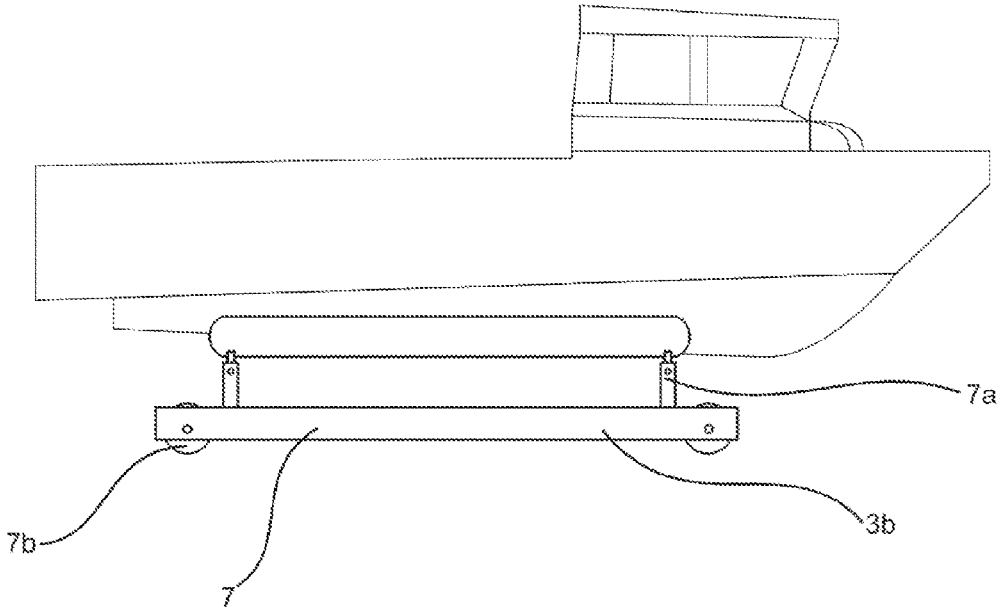
FIG. 11*b* is an enlarged side view of a longitudinally movable cradle with lifting device moved down and the daughter boat is lowered on the transversely movable cradle.
Figure 12B:
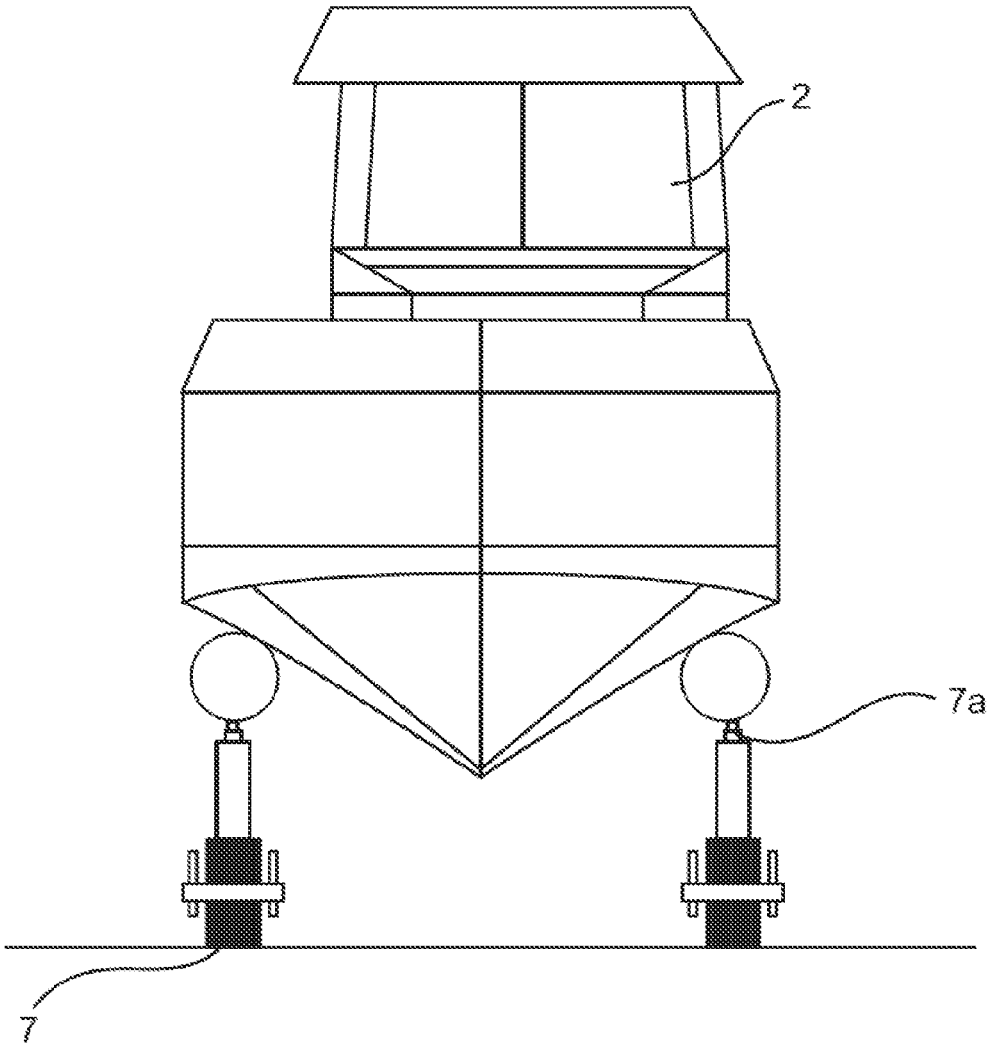

FIG. 12*b* is a view where the lifting device 7*a* has now come down so that the lifeboat 2 rests on the transversely movable cradle 4. FIG. 11*b* is just a side view of this position which is shown in FIG. 11*b*. Referring again to FIG. 1*b* in this context, the two extreme positions 7*c*, 7*d* to which the longitudinally movable cradles 7 can rise and fall back have been shown.

Having described elaborately the basic structure of the apparatus and the working interrelations of the various components now the functioning of the apparatus is described. For that purpose, all the above figures are again referred, of course without detailing the structural aspects again.

Referring to FIGS. 1*a*, 1*c* and 1*d* again, these figures show a stage when the launching operation has not begun and the lifeboats 2 are all parked on the respective longitudinally movable cradles 7. From FIGS. 1*a* and 1*d* in particular it would be clear that the transversely movable cradle 4 now rests atop a stationary cradle 5 at one side 11*a* of the deck 11. It could have rested on the stationary cradle 5 at the other side 11*b* as well and it is within the scope of the present invention, that the operation could have begun from the other side 11*b* as well.

Figure 2A:
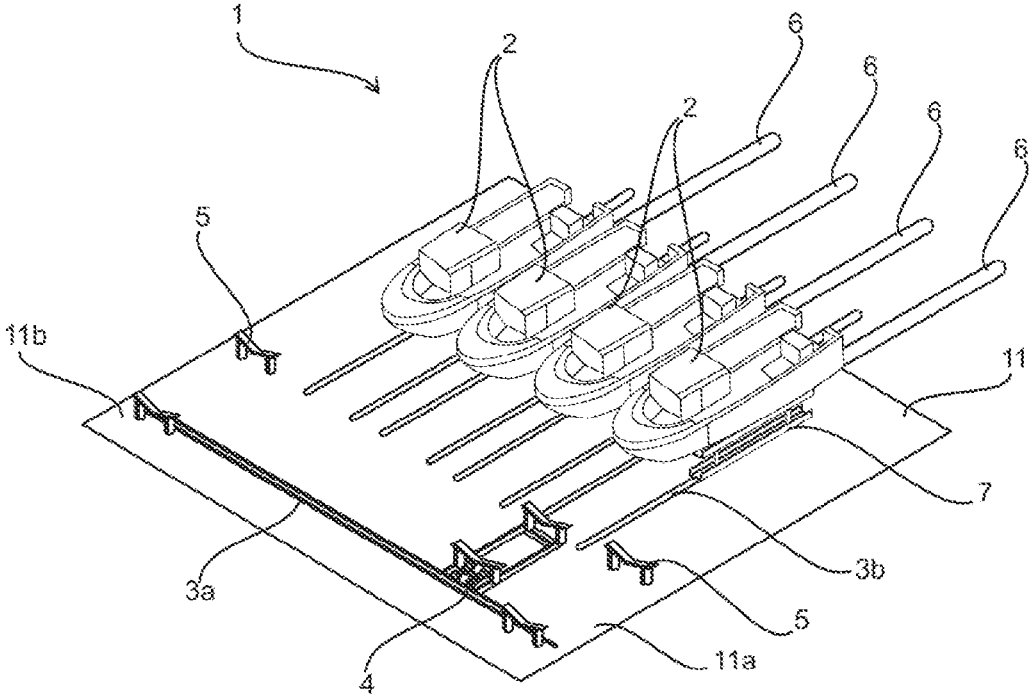
FIGS. 2*a*, 3*a*, 4*a*, 5*a*, 6*a*, 7*a*, 8*a*, 9*a* and 10*a* are perspective views of the apparatus shown in FIG. 1*a*, at various stages of launching operation in that order.

In any event, referring now to FIG. 2*a*, the transversely movable cradle 4 has now moved along the transverse rail 3*a* and aligned itself with the longitudinal cradle 7, which is the first one from the right. The first lifeboat 2 from the right is selected to be launched, according to the exemplary method described and illustrated.

Figure 2B:
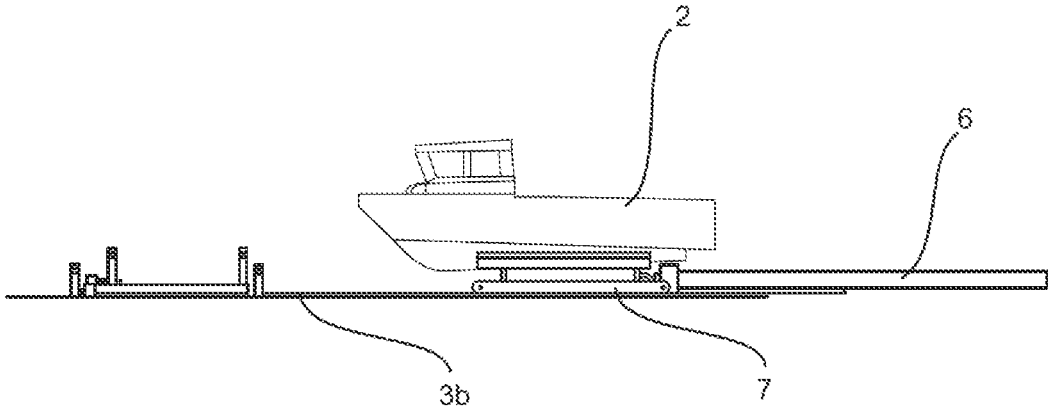
FIGS. 2*b* and 2*c* are side views and front views respectively of the perspective shown in FIG. 2*a*.
Figure 2C:
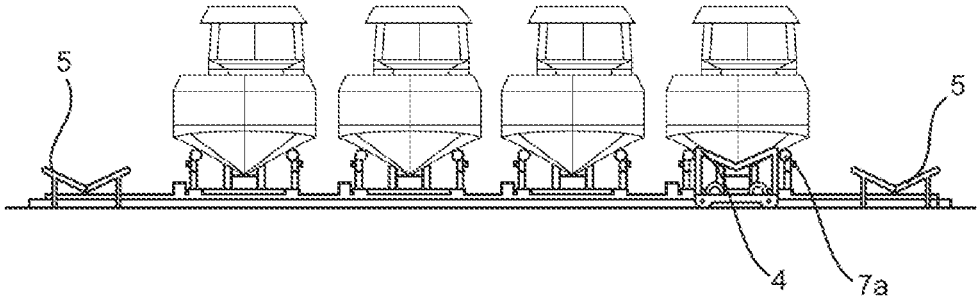

Referring to FIG. 2*b*, the lifeboat 2 selected for launching can be seen resting on the corresponding cradle 7. FIG. 2*c* shows that as described with reference to FIG. 2*b*, the transverse cradle 4 has aligned with the longitudinally movable cradle 7, on which the lifeboat 2 selected for launching rests. Now referring to FIG. 1*d* again, it would be clear how, the transverse motion of the cradle 4 takes place, away from the stationary cradle 5. Further, it would be now further clear with reference to FIGS. 1*a*, 1*b*, 1*c*, 1*d* and 2*a* that the transversely movable cradle 4 has a transverse rail 3*a* and wheels (not shown) at only the end which is opposite to the end from where it receives life boats 2.

Figure 3A:
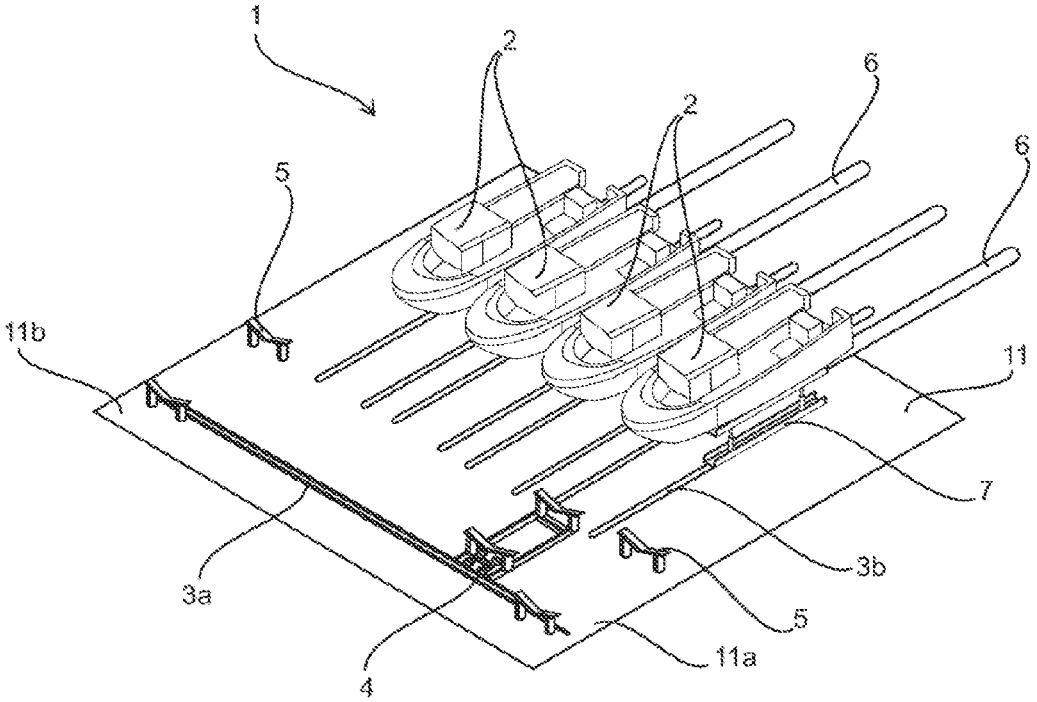

FIG. 3*a*, is the next stage, when the lifting device 7*a* of the longitudinally movable cradle 7 has started to rise up and reached its maximum vertical position 7*c* as shown in FIG. 1*d*. The side view of this stage in FIG. 3*b* further explains this aspect. This would be particularly clear from the front view in FIG. 3*c* of this stage. The enlarged view in FIG. 3*d*, which corresponds to the extreme right lifeboat position 2 in FIG. 3*c* clearly illustrates, that the lifeboat 2 is now at a height, which is above the transversely movable cradle 4.

Figure 3B:
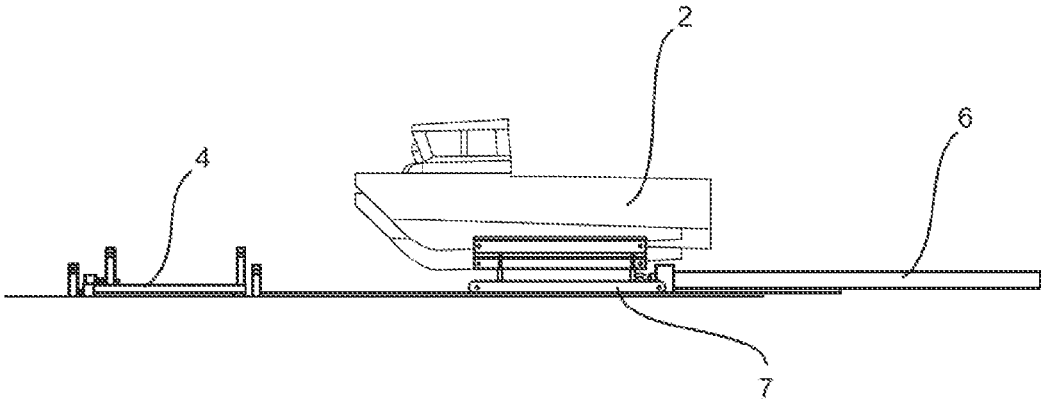
FIGS. 3*b*, 3*c*, 4*b*, 4*c*, 5*b*, 5*c*, 6*b*, 6*c*, are side views and front views respectively of the perspective views 3*a*, 4*a*, 5*a* and 6*a* in that order.
Figure 3C:
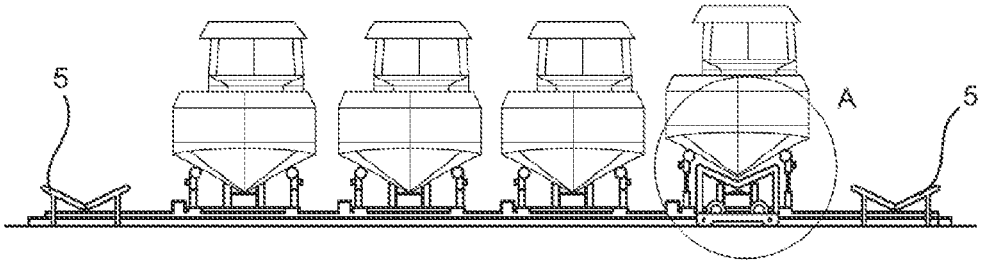
Figure 3D:
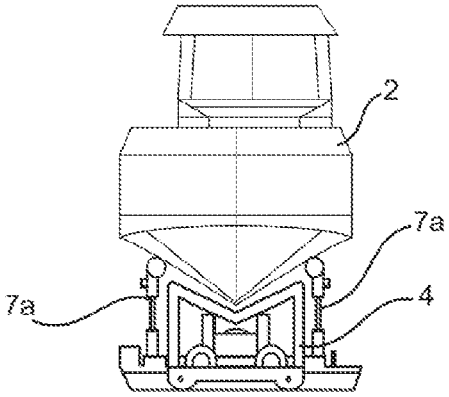
FIG. 3*d* is an enlarged view of the front view shown in FIG. 3*c* just as FIG. 5*d* is that of FIG. 5*c*.

However, at this stage, as it would be particularly clear from FIG. 3*b*, the cradle 7 has not started to move along the rail 3*b*. Hence, only one lifeboat 2 can be seen in the side view in FIG. 3*b*, which is the one selected to be launched.

Figure 4A:
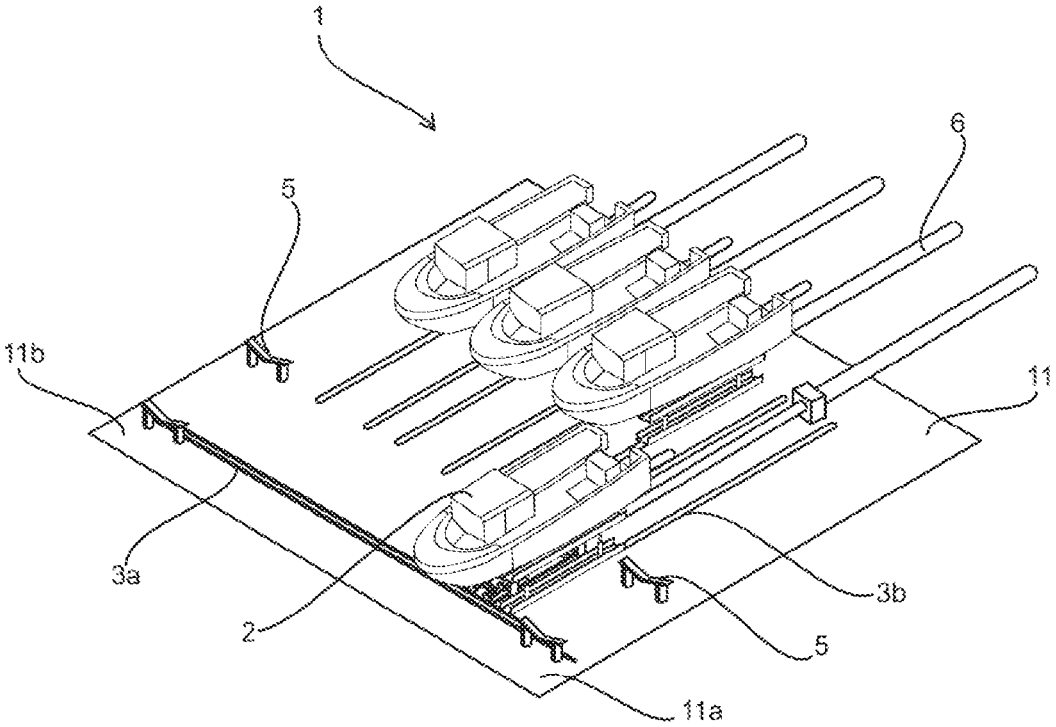
Figure 4B:
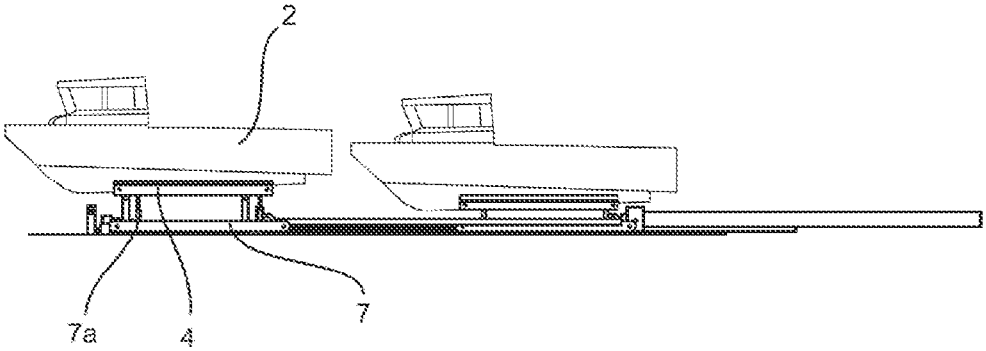

FIG. 4*a* is the next stage when the longitudinally movable cradle 7, along with the boat 2 selected for launching has moved very near to the transversely movable cradle 4. This would be clear in particular from FIGS. 4*a* and 4*b*, the latter clearly showing that the boat 2 selected for launching has moved very near the transversely movable cradle 4 ahead of the other boats. It would be clear from FIG. 4*a*, that the selected boat 2 and the respective longitudinally movable cradle 7 cannot move further beyond FIGS. 11*a* and 12*a* also illustrate this position when the lifeboat 2 is just atop the transversely movable cradle 4.

Figure 4C:
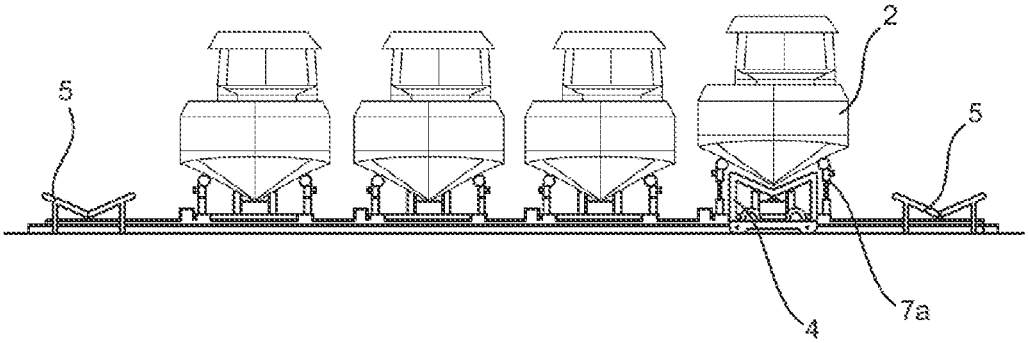

The stage described in the preceding paragraph, is also corroborated by the position shown in the front view in FIG. 4*c*.

Figure 5A:
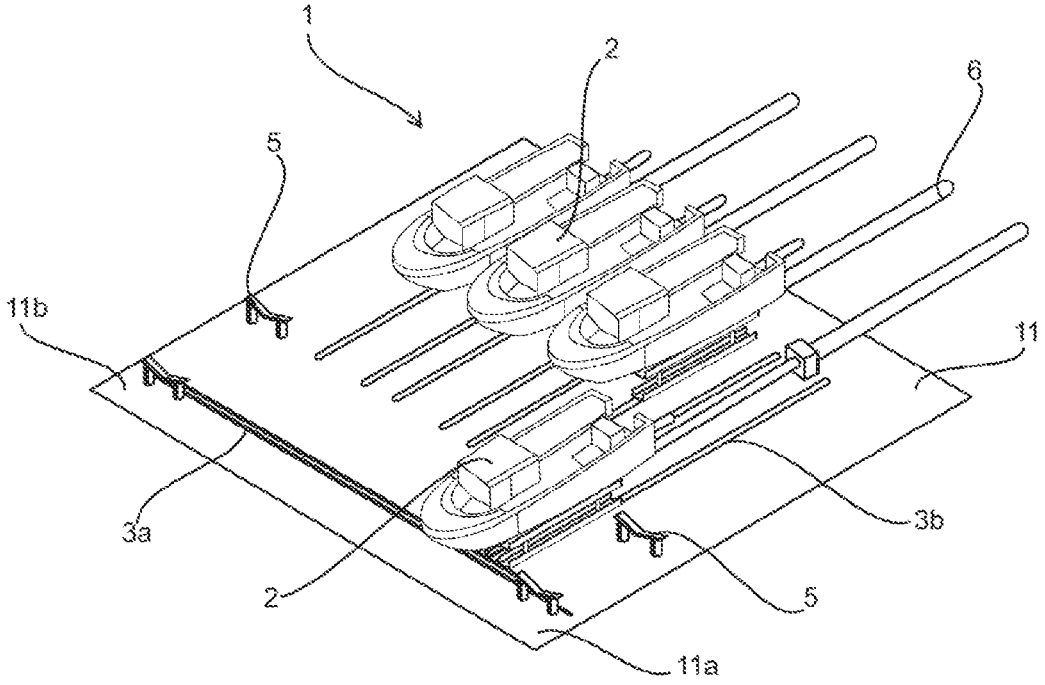
Figure 5B:
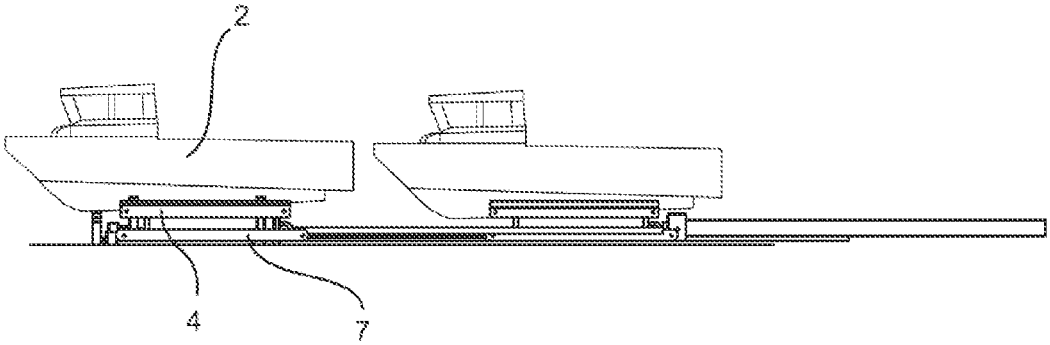
Figure 5C:
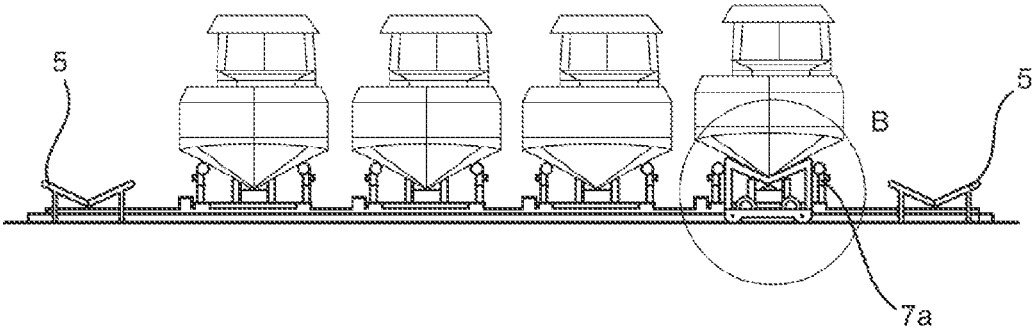
Figure 5D:
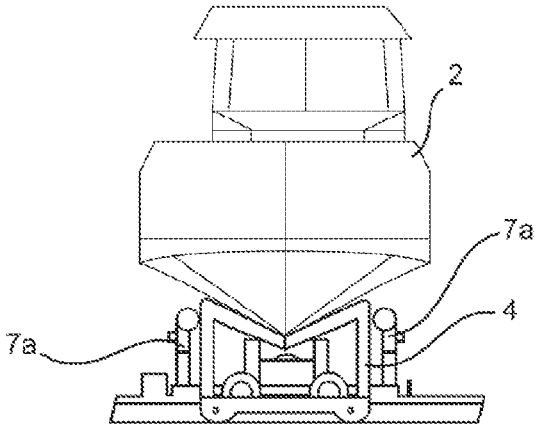

FIGS. 5*a*, 5*b* and 5*c* show the next stage when the lifting device 7*a* of the longitudinal cradle 7 has gone down to its lower most position 7*d* (best shown in FIG. 1*b*) and placed the life boat 2 to be launched on the transversely movable cradle 4. FIGS. 11*b* and 12*b* also clearly show this position. The enlarged view in FIG. 5*d* of the front view of the boat 2 selected for launching and the corresponding transversely movable cradle 4 further make this stage clear. The enlarged view in FIG. 5*d* clearly shows that the lifting device 7*a* has now come down and the lifeboat 2 rests on the transversely movable cradle 4.

Figure 6A:
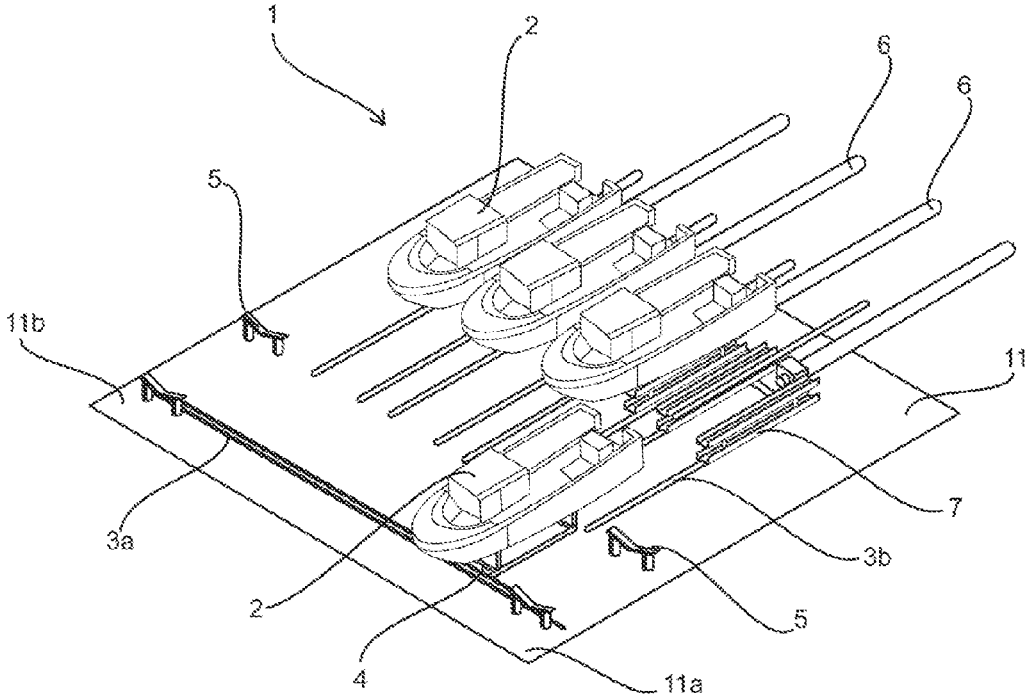
Figure 6B:
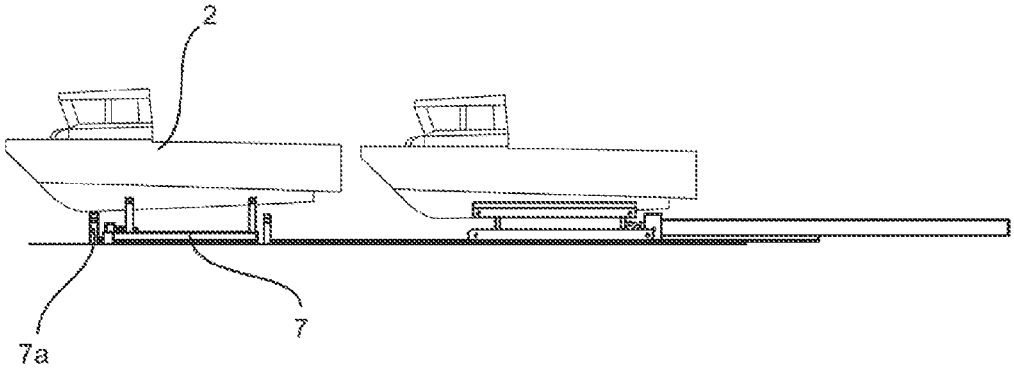
Figure 6C:
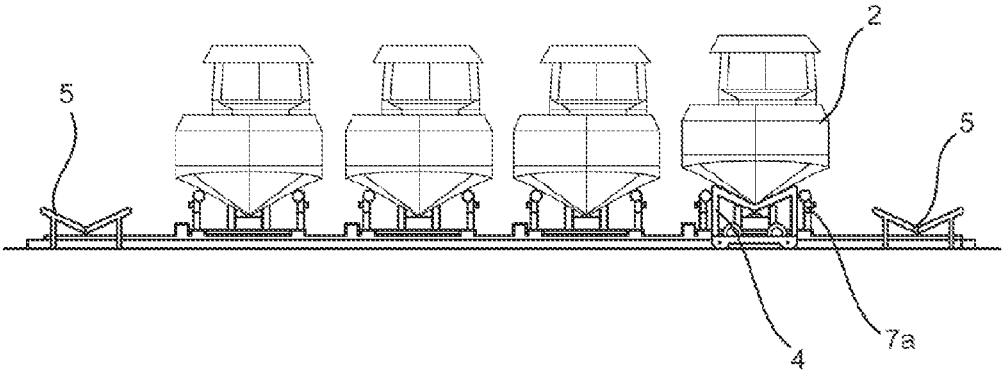

FIG. 6*a* shows the next stage when the longitudinal cradle 7 has moved back along the rail 3*b* to its original position. This stage is particularly clear from FIG. 6*a*. FIGS. 6*b* and 6*c* also corroborate this.

Figure 7A:
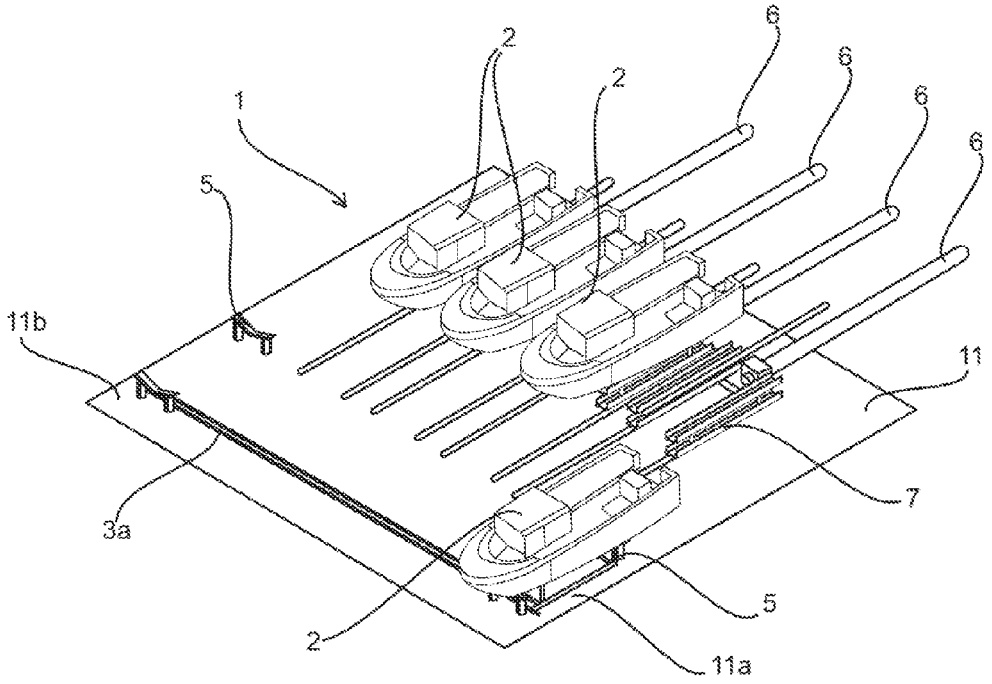
Figure 7B:
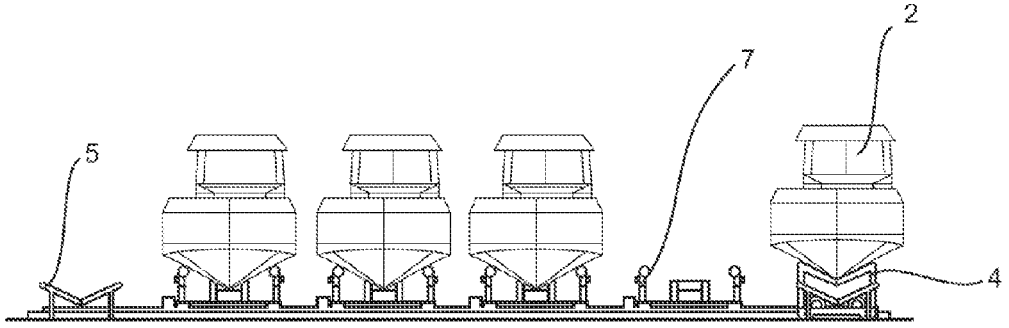
FIGS. 7*b*, 8*b*, 9*b* and 10*b* are front views of the corresponding perspective views 7*a*, 8*a*, 9*a* and 10*a*.

FIG. 7*a* illustrates the next stage, when the transversely movable cradle 7 has moved atop the stationary cradle 5. The front view in FIG. 7*b* makes this further clear. The longitudinally movable cradle 7 is seen empty. The lifeboat 2 rests on the transversely movable cradle 4 and the latter rests on the stationary cradle 5.

Figure 8A:
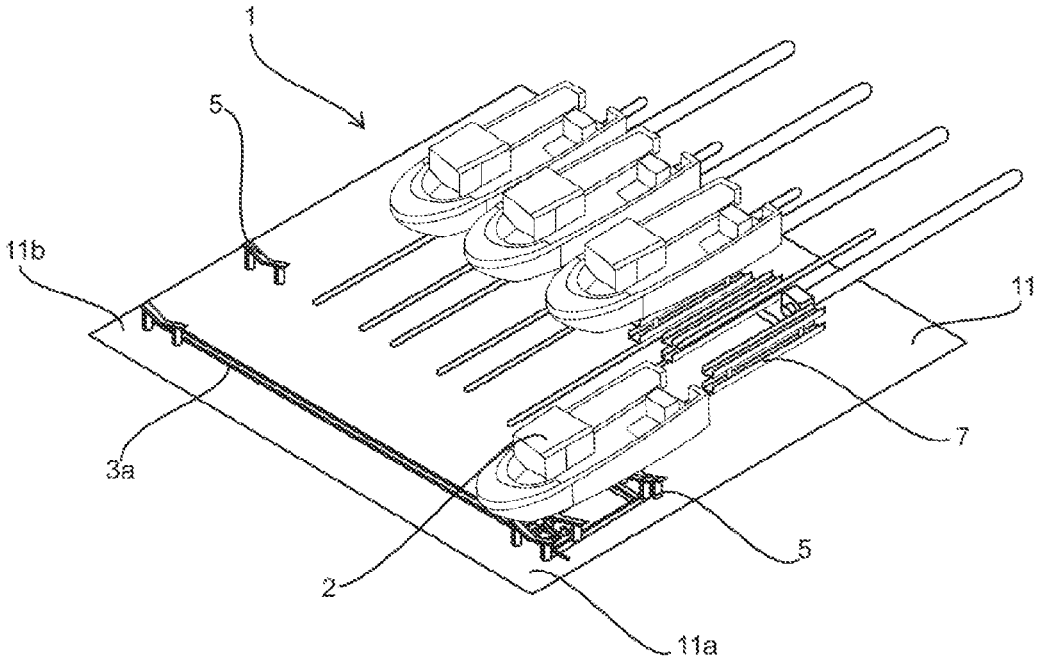
Figure 8B:
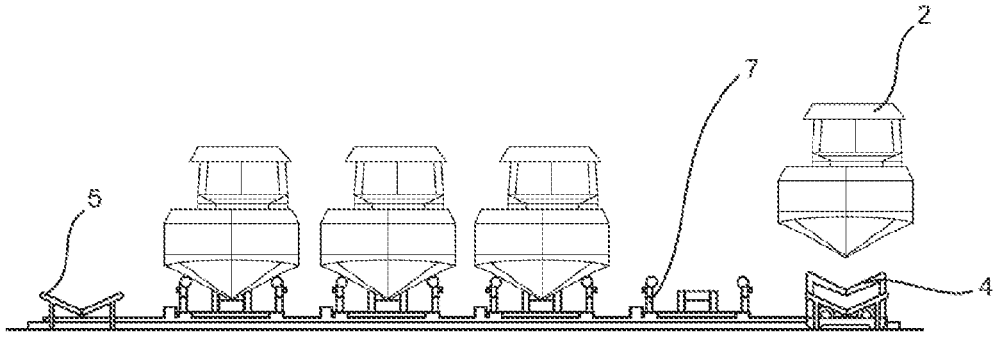

FIG. 8*a* illustrates the next stage when the davit (not shown) has lifted the boat 2 so that the transversely movable cradle 4 can slide back along the rail 3*a* for bringing the next boat. The front view 8*b* in particular clearly illustrates that the lifeboat 2 has been lifted above the transversely movable cradle 4, the latter being still atop the stationary cradle 5.

Figure 9A:
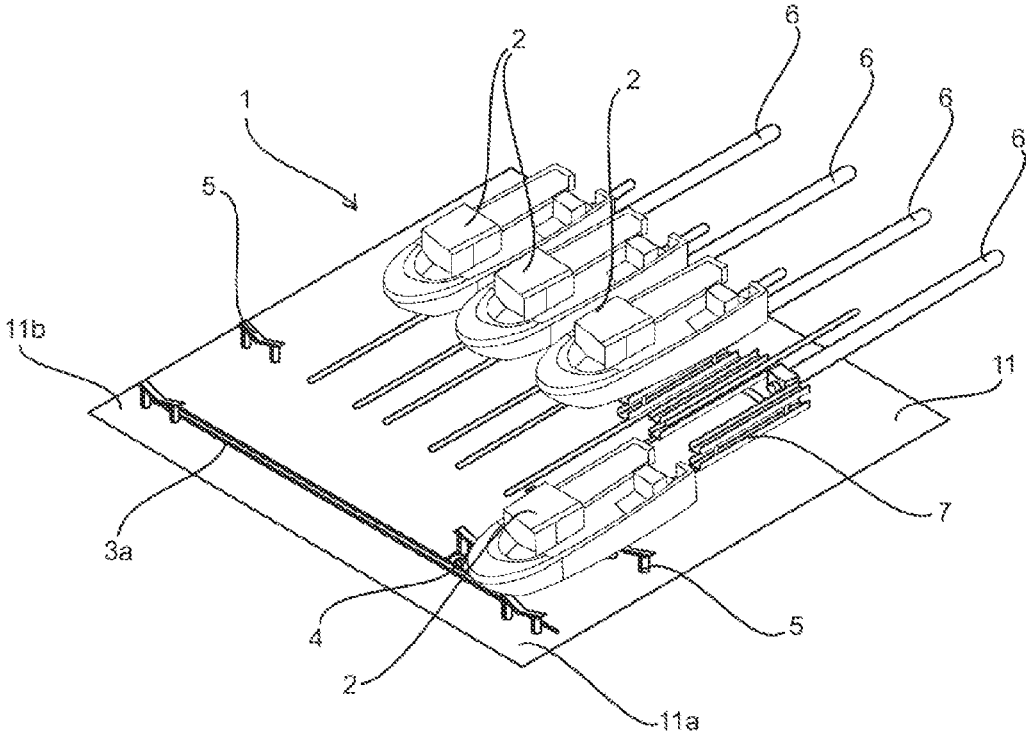
Figure 9B:
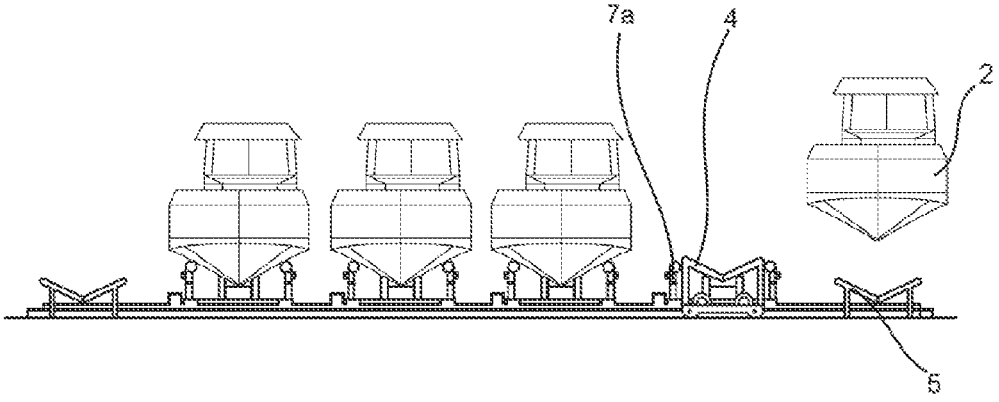

FIG. 9*a* illustrates the next stage when the transversely movable cradle 4 has moved away from the stationary cradle 5, towards the interior of the vessel for bringing another lifeboat 2. This would be particularly clear from the front view in FIG. 9*b*.

Figure 10A:
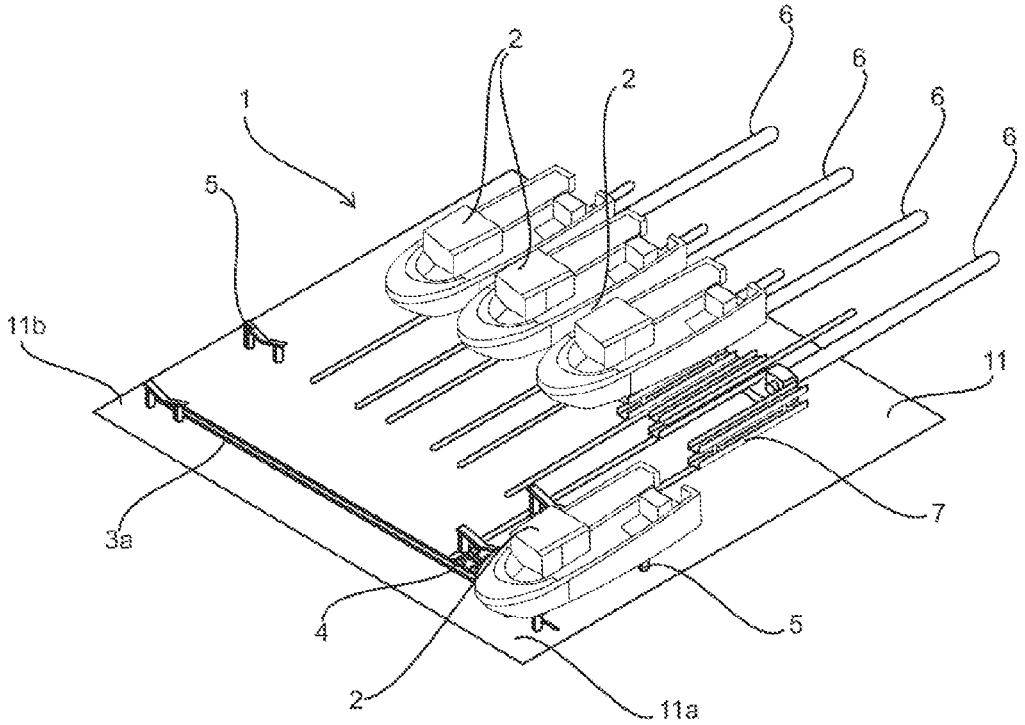
Figure 10B:
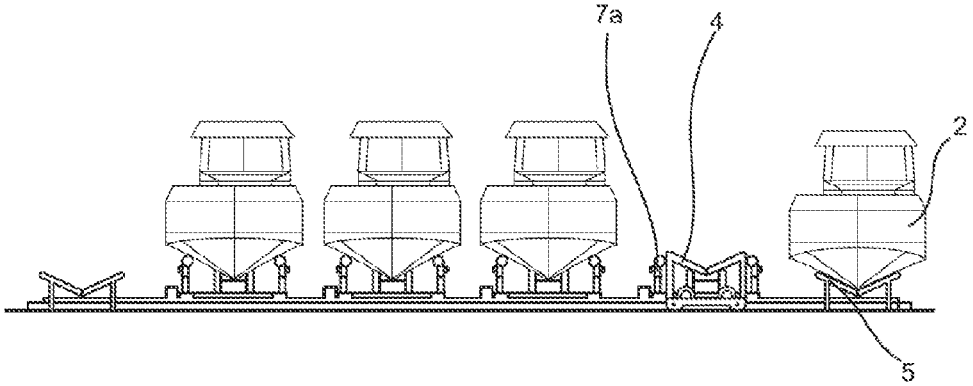

FIG. 10*a* is the next stage when the davit (not shown) has again lowered the lifeboat 2 on the stationary cradle 5. This position is also clear from FIG. 10*b* which is the front view. This is the launching position. The lifeboat 2 is now ready to be lowered on the sea. The next stage involves lowering of the lifeboat 2 on the sea by the davit.

The retrieval operation is just opposite to the launching opposition as explained with reference to the figures in the preceding description and it is not elaborated for the sake of brevity particularly as it would be clear to persons skilled in the art. In brief, it involves, lifting the boat 2 from the sea by a davit on a longitudinally movable cradle 4 atop a stationary cradle 5; moving the transversely movable cradle 4 along the transverse rail 3*a* and positioning it selectively in line with the longitudinal cradle 7 which is empty and on which the boat 2 is desired to be positioned.

Thereafter, the retrieving operation involves, applying the lifting device 7*a* to lift up the longitudinally movable cradle 7 to receive the boat 7 on the longitudinal cradle 7 and moving the longitudinally movable cradle 7 along longitudinal rail 3*b* towards the transversely movable cradle 4.

Then the retrieving operation involves, on reaching a suitable location by the longitudinally movable cradle 7, placing the boat 2 on the longitudinally movable cradle 7 by the transversely movable cradle 4 and lowering the lifting device 7*a* by the longitudinally movable cradle 7; moving back the longitudinally movable cradle along the rail 3*b* back to its original position on the deck 11; moving the transverse cradle 4 towards any one stationary cradle 5 along the transverse rail 3*a* and placing it on the stationary cradle 5.

The launching and retrieval steps can be repeated as many times as required. Thus it would be clear that a multiplicity of mother boats can be handled on the deck of the mother vessel easily and conveniently and that too with a very limited number of davits. One davit can launch and retrieve a substantially large number of boats. The in-built lifting mechanism of the longitudinally movable cradles makes the operation simple and yet cost effective. This is true in respect of using only one transversely movable cradle for launching retrieving daughter boats from either side of the mother vessel, which cradle has a rail and wheels only at one of its ends which is opposite to the end, that receives daughter boats. It is also possible to selectively launch lifeboats and retrieve lifeboats and park them on selected cradles on the deck.

From the description with reference to the drawings, it would be clear to persons skilled in the art that all objectives of the invention have been achieved.

The present invention has been described with reference to some preferred embodiments and some drawings for the sake of understanding only and it should be clear to persons skilled in the art that the present invention includes all legitimate modifications within the scope of what has been described hereinbefore and claimed in the appended claims.

The invention claimed is:

1. An apparatus comprising:

a stationary cradle located at a side edge of a deck of a mother vessel for launching and retrieving a daughter boat;

a longitudinally movable cradle on the deck of the mother vessel for securedly holding the daughter boat thereon, the longitudinally movable cradle being movable longitudinally and comprising a telescopic lift to vertically lift the daughter boat and transfer the daughter boat; and a transversely movable cradle which can transversely move to align with the longitudinally movable cradles for placing the daughter boat onto or for receiving the daughter boat from at least one the longitudinal cradle and the stationary cradle.

2. The apparatus according to claim 1, wherein there are at least two stationary cradles on either side of the deck for launching and retrieving the daughter boat from both sides of the vessel.

3. The apparatus according to claim 1, wherein:

the longitudinally movable cradle moves along longitudinal rails on wheels by means of a hydraulic cylinder arrangement; and the transversely movable cradle has a single transverse rail at one end of the transversely movable cradle and moves along the single transverse rail.

4. The apparatus according to claim 3, wherein the telescopic lift is hydraulically operated.

5. The apparatus according to claim 3, wherein the daughter boat has a dedicated longitudinally movable cradle for parking.

6. The apparatus according to claim 1, wherein the daughter boat is parked along a transverse hangar and is placed on fixed keel rests and longitudinally movable cradle can dislodge and move the daughter boat from the hangar and hold the daughter boat securedly for moving along longitudinal rails.

7. A method for launching boats by applying the apparatus according to claim 1, said method comprising:

(a) moving the transversely movable cradle along transverse rail and positioning it selectively in line with the longitudinal cradle on which the daughter boat desired to be launched is positioned;

(b) lifting the daughter boat on the longitudinal cradle and moving the daughter boat and the longitudinally movable cradle along longitudinal rail towards the transverse cradle;

(c) placing the daughter boat on the transverse cradle by lowering the longitudinally movable cradle;

(d) moving back the longitudinally movable cradle along the deck back to an original position of the longitudinally movable on the deck;

(e) moving the transverse cradle near any one stationary cradle along the transverse rail;

(f) placing the daughter boat on the stationary cradle;

(g) lifting the daughter boat to allow the transversely movable cradle to move away from the stationary cradle for bringing further daughter boats, placing the daughter boat on the stationary cradle and launching the daughter boat on sea; and (h) repeating steps (a) to (g) as many times as required.

8. A method for retrieving boats by applying the apparatus according to claim 1, said method comprising:

(a) lifting the daughter boat onto a longitudinally movable cradle atop a stationary cradle;

(b) moving the transversely movable cradle along transverse rail and positioning the transversely movable cradle selectively in line with the longitudinally movable cradle which is empty and on which the daughter boat is desired to be positioned;

(c) lifting the longitudinally movable cradle to receive the daughter boat on the longitudinally movable cradle and moving the longitudinally movable cradle along a longitudinal rail towards the transversely movable cradle;

(d) placing the daughter boat by the transversely movable cradle on the longitudinally movable cradle and lowering the longitudinally movable cradle;

(e) moving back the longitudinally movable cradle along the rail back to an original position of the longitudinally movable cradle on the deck;

(f) moving the transversely movable cradle towards any one stationary cradle along the transverse rail and placing it on the stationary cradle; and (g) repeating steps (a) to (f) as many times as required.

* * * * *